US011122868B2

(12) United States Patent
Lin

(10) Patent No.: US 11,122,868 B2
(45) Date of Patent: Sep. 21, 2021

(54) METHOD OF MANUFACTURING A CAP STRUCTURE

(71) Applicant: CHUNG CHWAN ENTERPRISE CO., LTD., Taoyuan (TW)

(72) Inventor: Yu-Pau Lin, Taoyuan (TW)

(73) Assignee: CHUNG CHWAN ENTERPRISE CO., LTD., Taoyuan (TW)

( * ) Notice: Subject to any disclaimer, the term of this patent is extended or adjusted under 35 U.S.C. 154(b) by 0 days.

(21) Appl. No.: 16/811,703

(22) Filed: Mar. 6, 2020

(65) Prior Publication Data

US 2020/0205529 A1 Jul. 2, 2020

Related U.S. Application Data

(63) Continuation-in-part of application No. 15/870,798, filed on Jan. 12, 2018, now abandoned.

(30) Foreign Application Priority Data

Nov. 24, 2017 (TW) ..... 106140962

(51) Int. Cl.
*A44B 19/30* (2006.01)
*B21D 53/54* (2006.01)

(52) U.S. Cl.
CPC ..... *A44B 19/308* (2013.01); *B21D 53/54* (2013.01)

(58) Field of Classification Search
CPC ..... A44B 19/308; A44B 19/26; B21D 53/54
See application file for complete search history.

(56) References Cited

U.S. PATENT DOCUMENTS

| | | | | |
|---|---|---|---|---|
| 4,271,567 | A | 6/1981 | Aoki | |
| 9,226,550 | B1 * | 1/2016 | Lin | A44B 19/262 |
| 2004/0078942 | A1 | 4/2004 | Hamada | |
| 2005/0125968 | A1 * | 6/2005 | Yamazaki | A44B 19/308 24/429 |
| 2009/0094804 | A1 | 4/2009 | Miyazaki et al. | |
| 2013/0318751 | A1 * | 12/2013 | Lin | A44B 19/42 24/429 |
| 2014/0338158 | A1 * | 11/2014 | Lin | A44B 19/26 24/431 |

(Continued)

FOREIGN PATENT DOCUMENTS

| | | | |
|---|---|---|---|
| CN | 201888335 | U | 7/2011 |
| CN | 102726895 | A | 10/2012 |

(Continued)

*Primary Examiner* — David M Upchurch
(74) *Attorney, Agent, or Firm* — Li & Cai Intellectual Property (USA) Office

(57) ABSTRACT

A method of manufacturing a cap structure includes providing an initial cap body; placing an elastic piece on an inner surface of the initial cap body; and then punching the initial cap body to form a cap body. The cap structure includes a cap body and an elastic piece. The cap body has at least two first inner concave grooves, at least two first retaining blocks and at least two first through holes. The at least two first inner concave grooves are disposed on the inner surface of the cap body, and the at least two first through holes pass through the cap body. The elastic piece is disposed on the inner surface of the cap body, and the at least two first retaining blocks contact the elastic piece for retaining or abutting the elastic piece.

8 Claims, 11 Drawing Sheets

(56) References Cited

U.S. PATENT DOCUMENTS

| | | | | |
|---|---|---|---|---|
| 2015/0351501 | A1* | 12/2015 | Zana | A44B 19/26<br>24/429 |
| 2016/0157566 | A1* | 6/2016 | Lin | A44B 19/262<br>24/429 |

FOREIGN PATENT DOCUMENTS

| | | | |
|---|---|---|---|
| CN | 203073165 | U | 7/2013 |
| CN | 203234148 | U | 10/2013 |
| CN | 203424412 | U | 2/2014 |
| CN | 103815622 | A | 5/2014 |
| CN | 104172676 | A | 12/2014 |
| CN | 204351211 | U | 5/2015 |
| JP | 3170680 | U | 9/2011 |

* cited by examiner

METHOD OF MANUFACTURING A CAP STRUCTURE

CROSS REFERENCE TO RELATED APPLICATIONS

This application is a continuation-in-part application of Ser. No. 15/870,798 filed on Jan. 12, 2018, and entitled "CAP STRUCTURE AND ZIPPER HEAD ASSEMBLY STRUCTURE", the entire disclosures of which are incorporated herein by reference.

FIELD OF THE INVENTION

The present disclosure relates to a cap structure, and more particularly to a method of manufacturing the cap structure.

BACKGROUND OF THE INVENTION

In general, zippers are basic elements in clothing or accessories. Compared to buttons, the zippers are easier to use. A conventional zipper comprises a zipper head and a tape. The zipper head works with the tape to allow the pulling action. Recently, the zipper has been used commonly for clothing, pants, backpack, and other accessories.

A conventional zipper head assembly structure includes a fastening slider, a pulling piece, a horse-like hook and a cap. The above components of the conventional zipper head assembly structure are assembled in the following procedure. One end portion of the pulling piece is positioned into a recessed space of the fastening slider. The pulling piece is pushed toward one end of the fastening slider, so that a first fixing base or a second fixing base of the fastening slider can be put around a hole of the pulling piece. Then, the horse-like hook is fixed to the first fixing base and the second fixing base of the fastening slider. The head portion of the horse-like hook is positioned in a groove of the first fixing base, while the tail portion of the horse-like hook is positioned to abut against the bottom of the groove of the second fixing base. The abdominal portion of the horse-like hook is supported on the end portion of the pulling piece. The stop portion of the horse-like hook extends into a sliding groove of the fastening slider via a horse-like hook hole between the first fixing base and the second fixing base. Finally, the cap is used to cover on the first fixing base and the second fixing base of the fastening slider. An elastic piece is inserted into the interior of the cap for abutting on the horse-like hook.

SUMMARY OF THE INVENTION

One aspect of the present disclosure relates to a method of manufacturing a cap structure.

One of the embodiments of the present disclosure provides a method of manufacturing a cap structure, comprising: providing an initial cap body; placing an elastic piece on an inner surface of the initial cap body; and then punching the initial cap body to form a cap body. The cap body includes at least two first retaining blocks for retaining the elastic piece and at least two first through holes respectively adjacent to the at least two first retaining blocks. The cap body has an inner surface, an outer surface, and a bottom surface connected between the inner surface and the outer surface, and the at least two first through holes pass through the cap body to form two breach holes between the inner surface and the outer surface of the cap body. Each of the first retaining blocks has an inner surface extending inwardly from the inner surface of the cap body, and the inner surface of the first retaining block is inclined at a first adjustable angle relative to the inner surface of the cap body. The first adjustable angle of one of the at least two first retaining blocks relative to the inner surface of the cap body is larger than, equal to or smaller than the first adjustable angle of another one of the at least two first retaining blocks relative to the inner surface of the cap body. Each of the first retaining blocks has a first top side surface connected to the inner surface of the cap body, a first bottom side surface opposite to the first top side surface and connected to the inner surface of the cap body, and a first front surface connected between the first top side surface and the first bottom side surface and separated from the inner surface of the cap body, and the elastic piece is supported by the two first top side surfaces of the at least two first retaining blocks so as to hold the elastic piece on a predetermined plane without being changed by a change of the first adjustable angle.

Therefore, by virtue of "the inner surface of the retaining block being inclined at an adjustable angle relative to the inner surface of the cap body" and "the elastic piece being supported by the at least two retaining blocks so as to hold the elastic piece on a predetermined plane", the elastic piece can be held on the predetermined plane without being changed by a change of the adjustable angle.

To further understand the techniques, means and effects of the present disclosure, the following detailed descriptions and appended drawings are hereby referred to, such that, and through which, the purposes, features and aspects of the present disclosure can be thoroughly and concretely appreciated. However, the appended drawings are provided solely for reference and illustration, without any intention to limit the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION OF THE PREFERRED EMBODIMENTS

Figure 1:
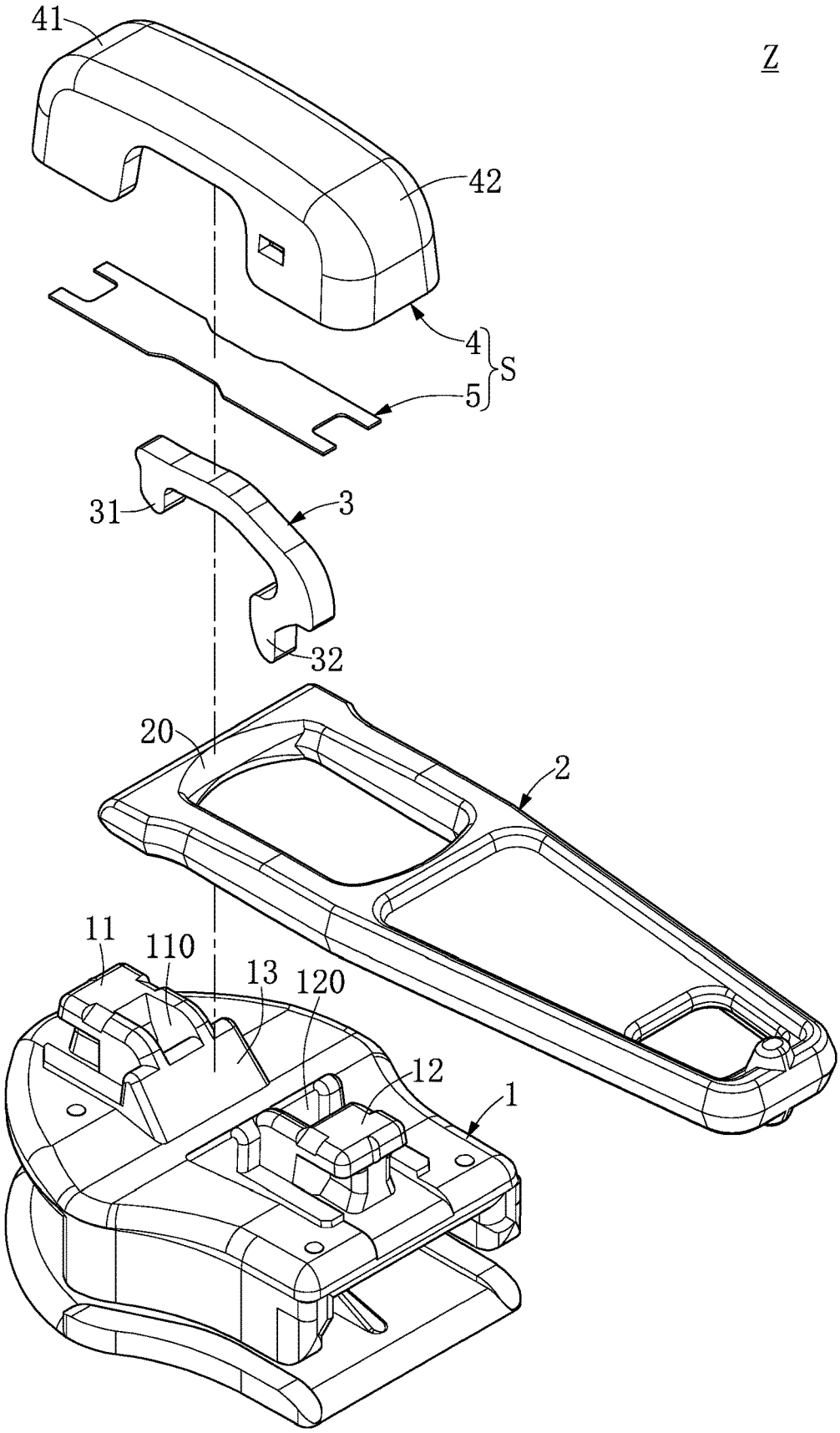
FIG. 1 shows a perspective, exploded, schematic view of the zipper head assembly structure according to the first embodiment of the present disclosure.

Embodiments of a cap structure and a zipper head assembly structure according to the present disclosure are described herein. Other advantages and objectives of the present disclosure can be easily understood by one skilled in the art from the disclosure. The present disclosure can be applied in different embodiments. Various modifications and variations can be made to various details in the description for different applications without departing from the scope of the present disclosure. The drawings of the present disclosure are provided only for simple illustrations, but are not drawn to scale and do not reflect the actual relative dimensions. The following embodiments are provided to describe in detail the concept of the present disclosure, and are not intended to limit the scope thereof in any way.

It should be noted that the terms "first", "second", "third", etc. may be used herein to describe various elements or signals; however, such terms should not be construed as limiting the elements or signals. These terms are used mainly for distinguishing one element from another, or distinguishing one signal from another. In addition, the term "or" may be used to include any one or any combination of the listed items, as the case may be.

First Embodiment

Referring to FIG. 1 to FIG. 6, the first embodiment of the present disclosure provides a zipper head assembly structure Z, including: a sliding member 1 (or a sliding head), a pull tab 2 (or a pull piece), a locking hook 3 (or a horse-like hook), a cap body 4 and an elastic piece 5 (or a flat spring), and the cap body 4 and the elastic piece 5 can be combined with each other to form a cap structure S.

Figure 2:
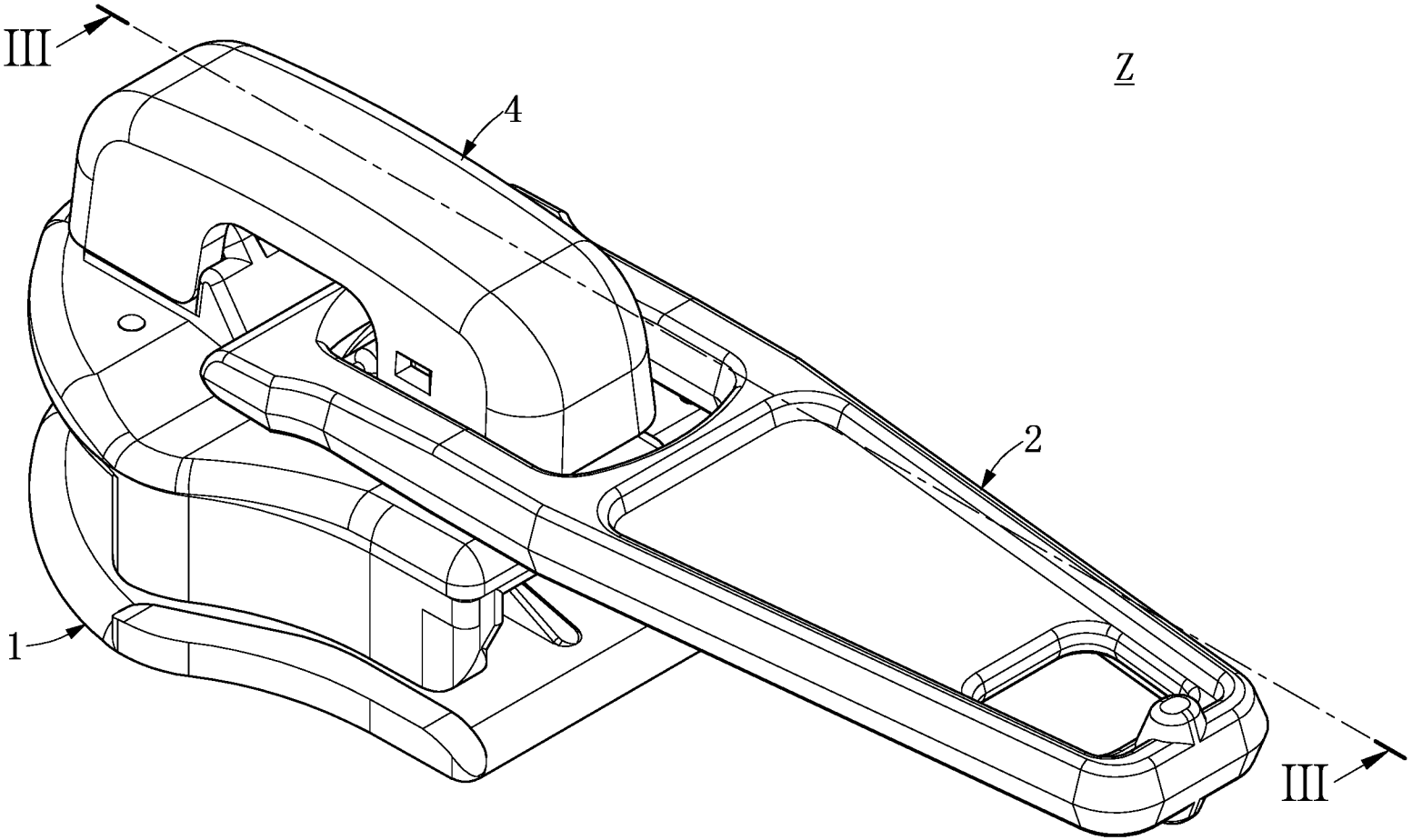
FIG. 2 shows a perspective, assembled, schematic view of the zipper head assembly structure according to the first embodiment of the present disclosure.
Figure 3:
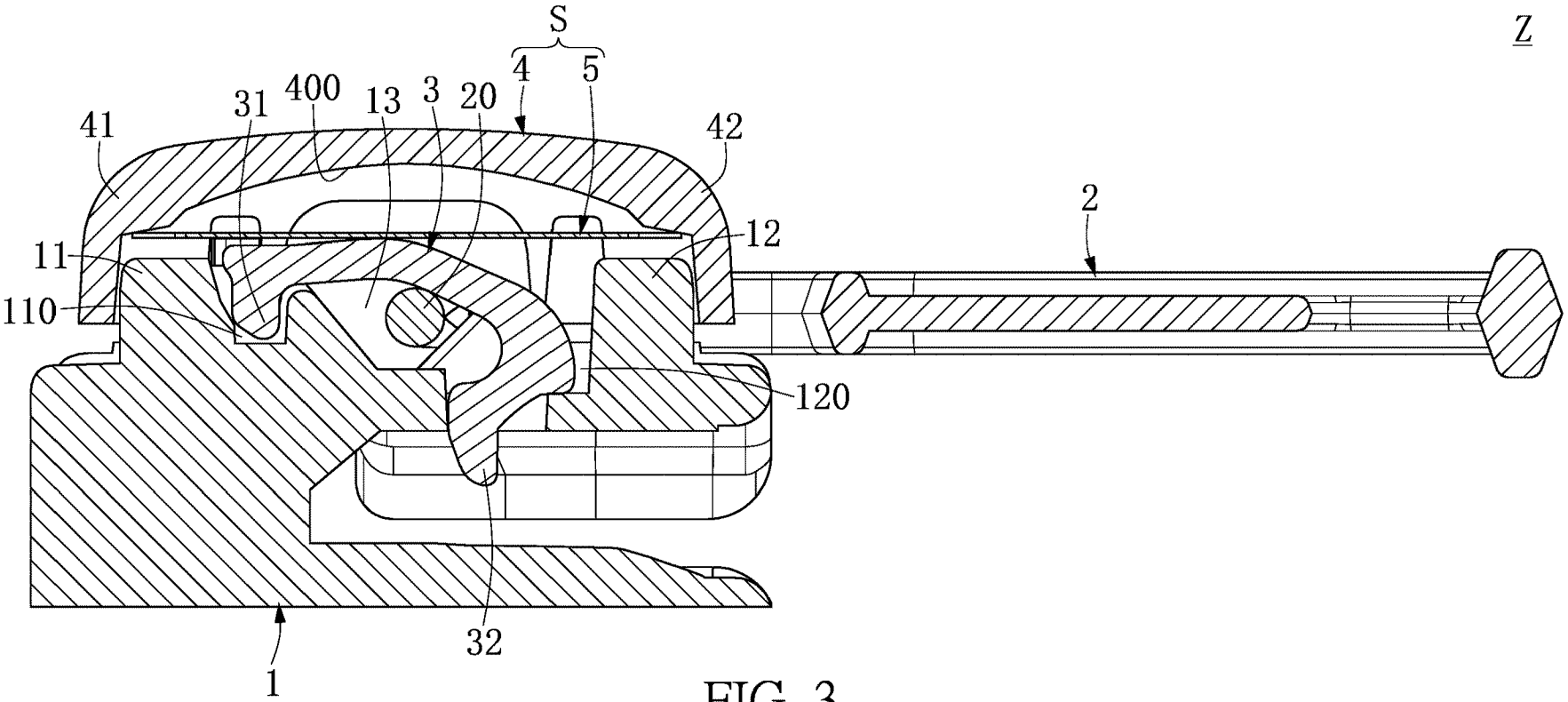
FIG. 3 shows a cross-sectional view taken along the section line III-III of FIG. 2.

Firstly, referring to FIG. 1 to FIG. 3, the sliding member 1 has a first retaining seat 11 and a second retaining seat 12. The first retaining seat 11 has a hook groove 100 shown as a blind hole, and the second retaining seat 12 has a hook hole 120 shown as a through hole. The pull tab 2 has an end portion 20 disposed inside a receiving space 13 formed between the first retaining seat 11 and the second retaining seat 12. The locking hook 3 is disposed on the sliding member 1, and the locking hook 3 has a first end portion 31 disposed inside the hook groove 110 and a second end portion 32 opposite to the first end portion 31 and passing through the hook hole 120 to form a stop portion. The cap body 4 has two opposite end portions (41, 42) respectively disposed on the first retaining seat 11 and the second retaining seat 12, the elastic piece 5 is disposed between the inner surface 400 of the cap body 4 and the locking hook 3 and abutted against the locking hook 3, and both the locking hook 3 and the elastic piece 5 are disposed between the sliding member 1 and the cap body 4 (as shown in FIG. 2 and FIG. 3).

Figure 4:
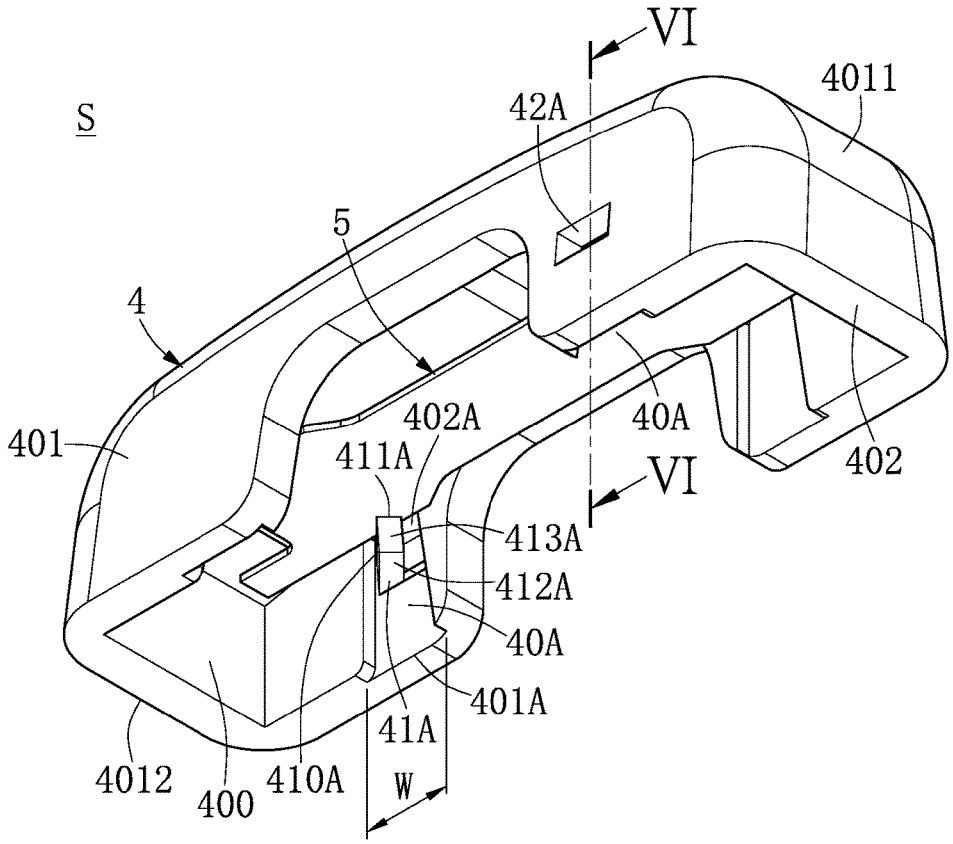
FIG. 4 shows a perspective, schematic view of a cap structure according to the first embodiment of the present disclosure.
Figure 5:
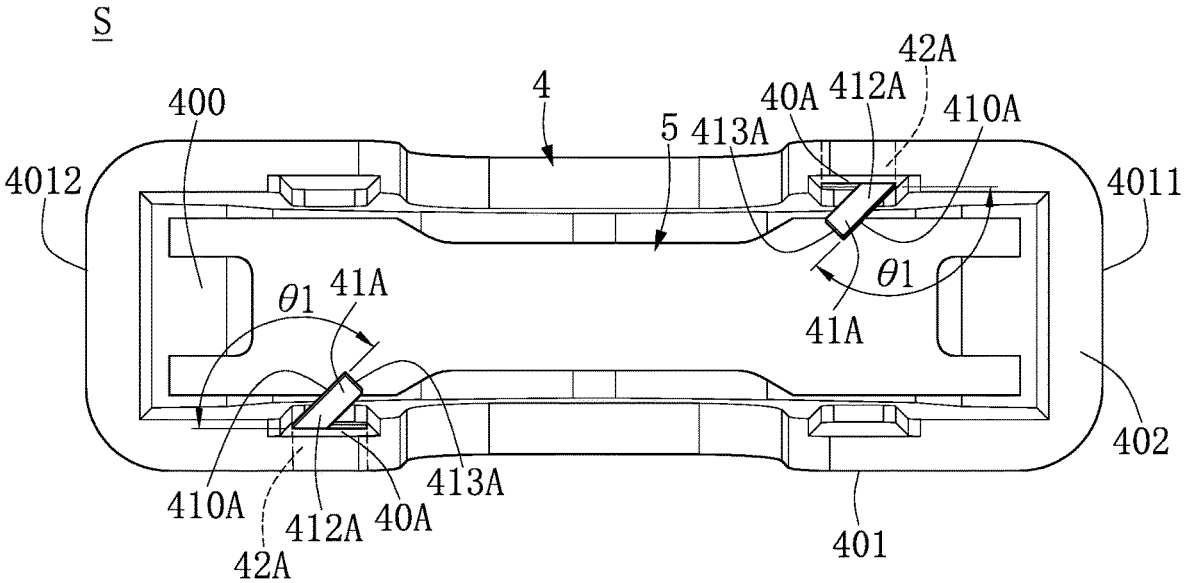
FIG. 5 shows a bottom, schematic view of the cap structure according to the first embodiment of the present disclosure.
Figure 6:
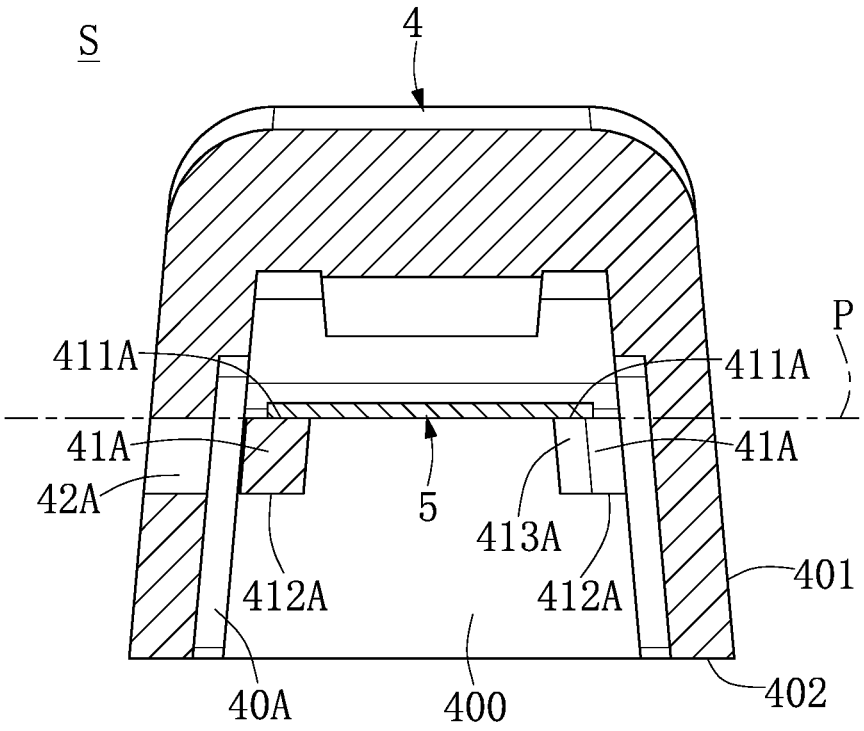
FIG. 6 shows a cross-sectional view taken along the section line VI-VI of FIG. 4.

Moreover, referring to FIG. 4 to FIG. 6, the cap body 4 includes at least two first inner concave grooves 40A corresponding to each other, at least two first retaining blocks 41A corresponding to each other and respectively extending outwardly from the two first inner concave grooves 40A, and at least two first through holes 42A corresponding to each other and respectively adjacent to the two first retaining blocks 41A. The two first retaining blocks 41A can contact the elastic piece 5 for retaining or abutting the elastic piece 5 (i.e., the elastic piece 5 can be retained inside the cap body 4 through the two first retaining blocks 41A). In addition, the cap body 4 has an inner surface 400, an outer surface 401 and a bottom surface 402 connected between the inner surface 400 and the outer surface 401, the two first inner concave grooves 40A are disposed on the inner surface 400 of the cap body 4, and the two first through holes 42A pass through the cap body 4 to form two breach holes between the inner surface 400 and the outer surface 401 of the cap body 4 (for example, the two breach holes 42A are formed by dotting or punching the cap body 4 from the outer surface 401 to the inner surface 400). Therefore, the two first inner concave grooves 40A can be formed on the inner surface 400 of the cap body 4 in advance, so that the thickness between the inner surface 400 and the outer surface 401 of the cap body 4 can be decreased or thinned (that is to say, the thickness of the material of the cap body 4 can be decreased or thinned), and thus it is easy to concurrently form the first through hole 42A and the first retaining block 41A by a dotting or punching machine.

More particularly, referring to FIG. 5, the two first inner concave grooves 40A can be diagonally disposed on the inner surface 400 of the cap body 4, and the two first inner concave grooves 40A are respectively adjacent to two opposite end sides (4011, 4012) of the cap body 4. The two first retaining blocks 41A can be respectively and diagonally disposed on the two first inner concave grooves 40A, and the two first retaining blocks 41A are respectively adjacent to the two opposite end sides (4011, 4012) of the cap body 4. The two first through holes 42A can be diagonally disposed on the outer surface 401 of the cap body 4, and the two first through holes 42A are respectively adjacent to the two opposite end sides (4011, 4012) of the cap body 4. In other words, the two first inner concave grooves 40A and the two first retaining blocks 41A are disposed on the long lateral side of the inner surface 400 of the cap body 4, and the two first through holes 42A are disposed on the long lateral side of the outer surface 401 of the cap body 4. Therefore, the position of the first inner concave groove 40A, the first retaining block 41A, or the first through hole 42A is rotated relative to the end side (4011 or 4012) of the cap body 4 by 90 degrees.

For example, referring to FIG. 4, each first inner concave groove 40A has a first end 401A connected to the bottom surface 402 of the cap body 4 and a second end 402A opposite to the first end 401A and far away from the bottom surface 402 of the cap body 4, and the width W of the first inner concave groove 40A is narrowed gradually from the first end 401A to the second end 402A of the first inner concave groove 40A. However, the above-mentioned design for the first inner concave groove 40A of the first embodiment is merely an example and is not meant to limit the present disclosure. In addition, referring to FIG. 5 and FIG. 6, each first retaining block 41A is adjacent to the second end 402A of the corresponding first inner concave groove 40A, and each first through hole 42A is adjacent to the second end 402A of the corresponding first inner concave groove 40A.

Referring to FIG. 4 to FIG. 6, it should be noted that each of the first retaining blocks 41A (i.e., the retaining block) has an inner surface 410A extending inwardly from the inner surface 400 of the cap body 4 (that is to say, the inner surface 410A extends along a long axle of the cap body 4, not along a short axle of the cap body 4), and the inner surface 410A of the first retaining block 41A is inclined at a first adjustable angle θ1 (i.e., an adjustable angle) relative to the inner surface 400 of the cap body 4. For example, the first adjustable angle θ1 of each first retaining blocks 41A relative to the inner surface 400 of the cap body 4 is changeable or adjustable, so that the first adjustable angle θ1 of one of the at least two first retaining blocks 41A relative to the inner surface 400 of the cap body 4 can be larger than, equal to or smaller than the first adjustable angle θ1 of another one of the at least two first retaining blocks 41A relative to the inner surface 400 of the cap body 4 as shown in FIG. 5. In addition, each of the first retaining blocks 41A has a first top side surface 411A connected to the inner surface 400 of the cap body 4, a first bottom side surface 412A opposite to the first top side surface 411A and connected to the inner surface 400 of the cap body 4, and a first front surface 413A connected between the first top side surface 411A and the first bottom side surface 412A and separated from the inner surface 400 of the cap body 4. Moreover, the elastic piece 5 can contact the two first top side surfaces 411A of the at least two first retaining blocks 41A and can be separated from the two first front surfaces 411A of the at least two first retaining blocks 41A. In addition, the elastic piece 5 is supported by the two first top side surfaces 411A of the at least two first retaining blocks 41A so as to hold the elastic piece 5 on a predetermined plane P without being changed by a change of the first adjustable angle θ1. That is to say, no matter how the first adjustable angle θ1 is adjusted or changed, the elastic piece 5 can be supported by the two first top side surfaces 411A so as to keep the elastic piece 5 on the predetermined plane P, so that the elastic piece 5 cannot be inclined when the first adjustable angle θ1 is adjusted or changed.

Figure 7:
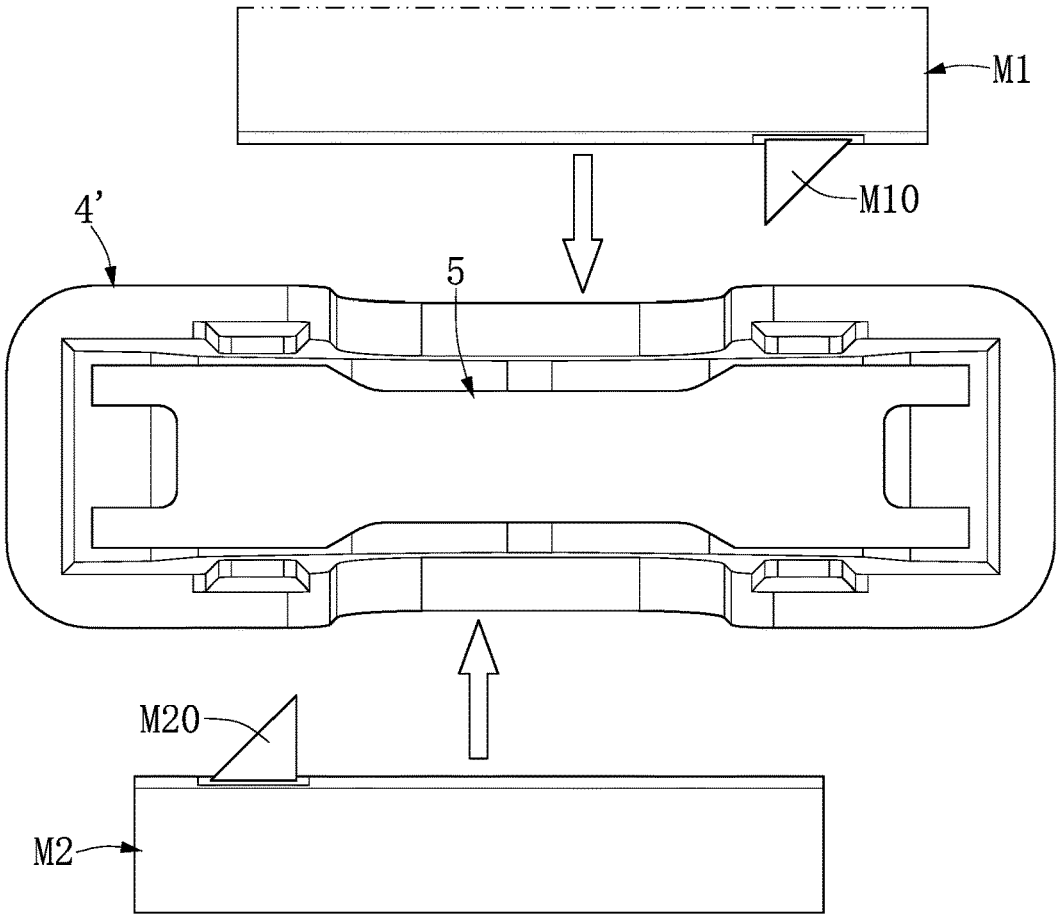
FIG. 7 show a schematic view of the two first retaining blocks having not been formed on the cap structure yet according to the first embodiment of the present disclosure.
Figure 8:
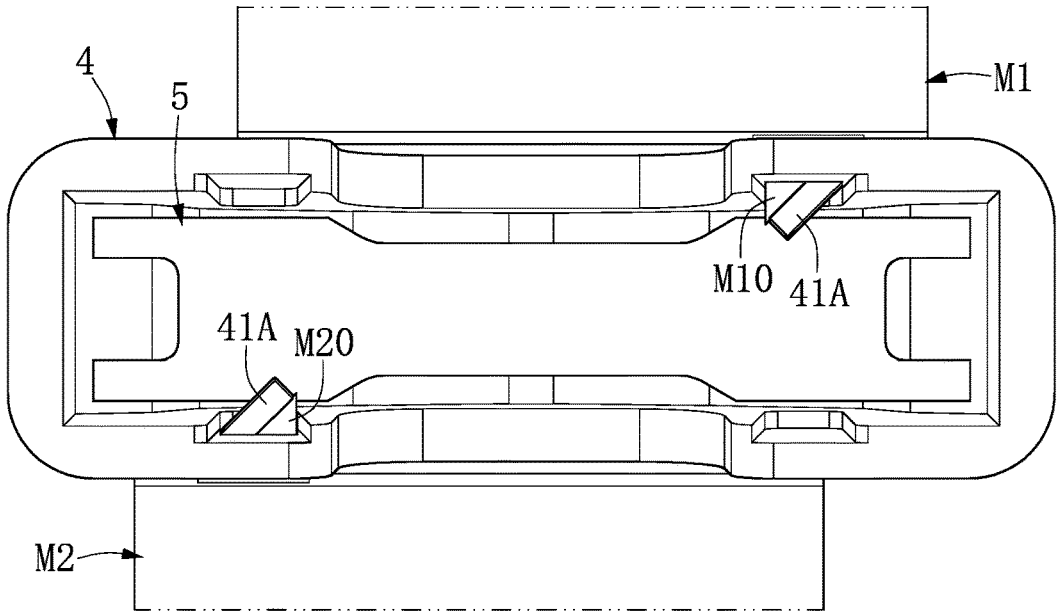
FIG. 8 show a schematic view of the two first retaining blocks having been formed on the cap structure according to the first embodiment of the present disclosure.

For example, referring to FIG. 7 and FIG. 8, the present disclosure provides a first mold M1 including a first processing tool M10, and a second mold M2 including a second processing tool M20. The first processing tool M10 and the second processing tool M20 can be respectively inserted into two lateral sides of an initial cap body 4', so that the at least two first retaining blocks 41A can be formed by punching.

Figure 9:
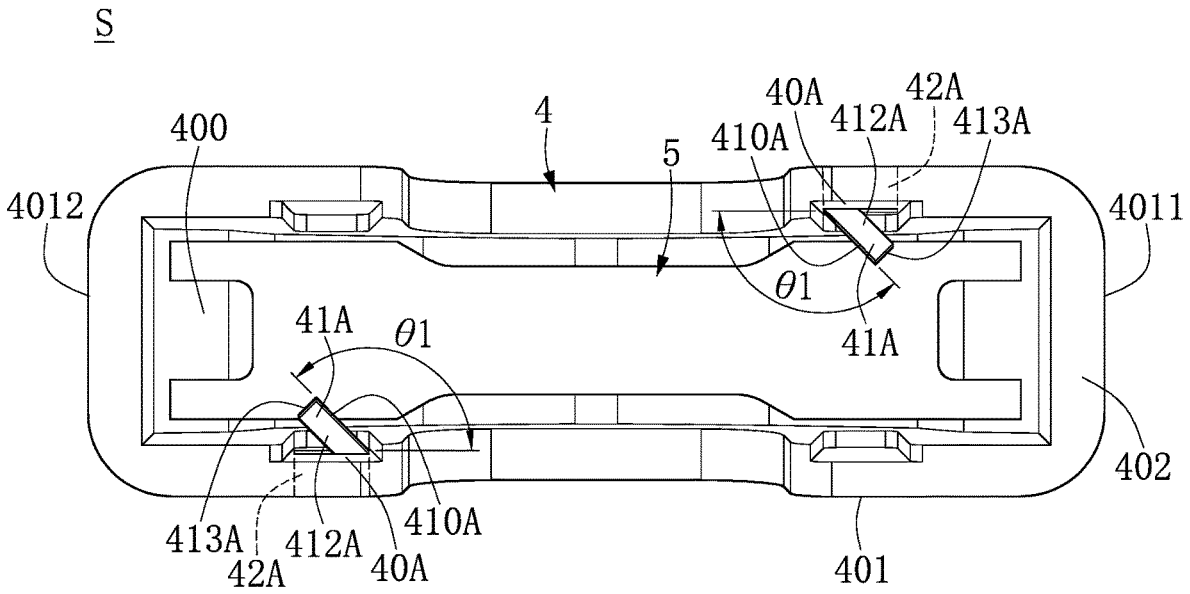
FIG. 9 show a bottom, schematic view of another cap body according to the first embodiment of the present disclosure.

Referring to FIG. 5 and FIG. 9, it should be noted that the extending direction of each of the at least two first retaining blocks 41A can be changed according to different requirements, but no matter how the extending direction of each of the at least two first retaining blocks 41A is changed, the elastic piece 5 can be supported by the two first top side surfaces 411A so as to keep the elastic piece 5 on the predetermined plane P, so that the elastic piece 5 cannot be inclined when the extending direction of each of the at least two first retaining blocks 41A is changed.

Second Embodiment

Figure 10:
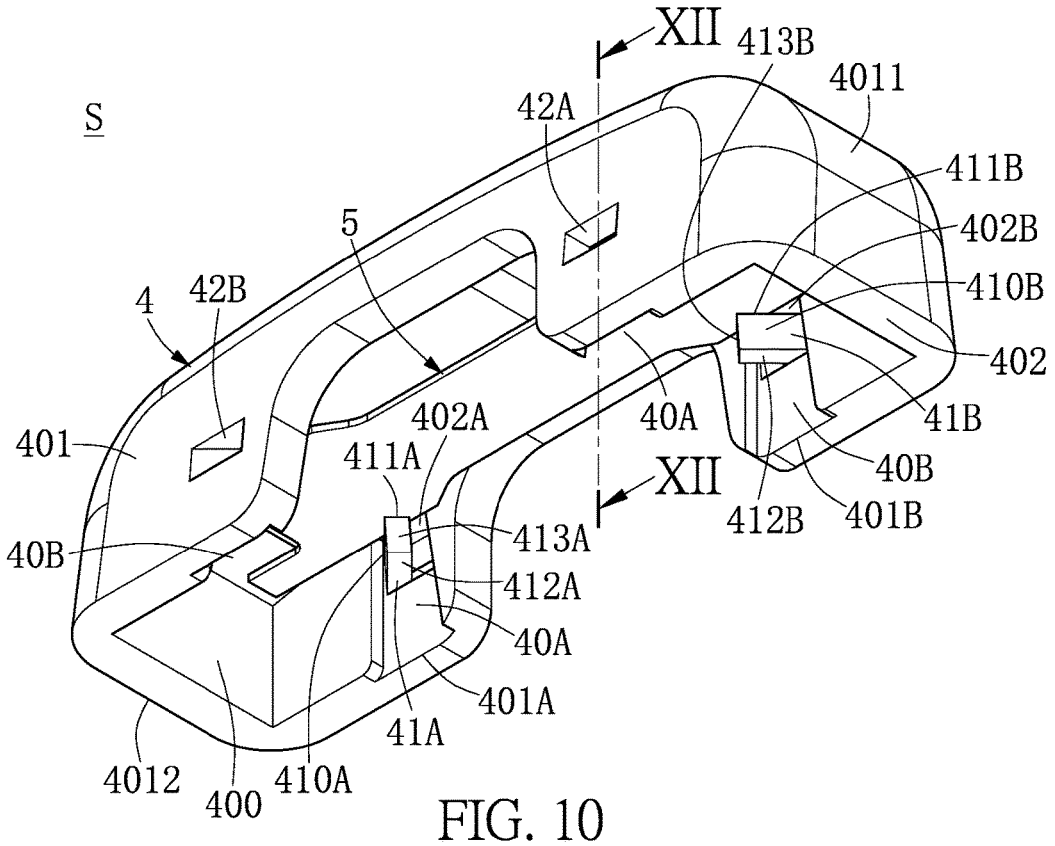
FIG. 10 shows a perspective, schematic view of a cap structure according to the second embodiment of the present disclosure.
Figure 11:
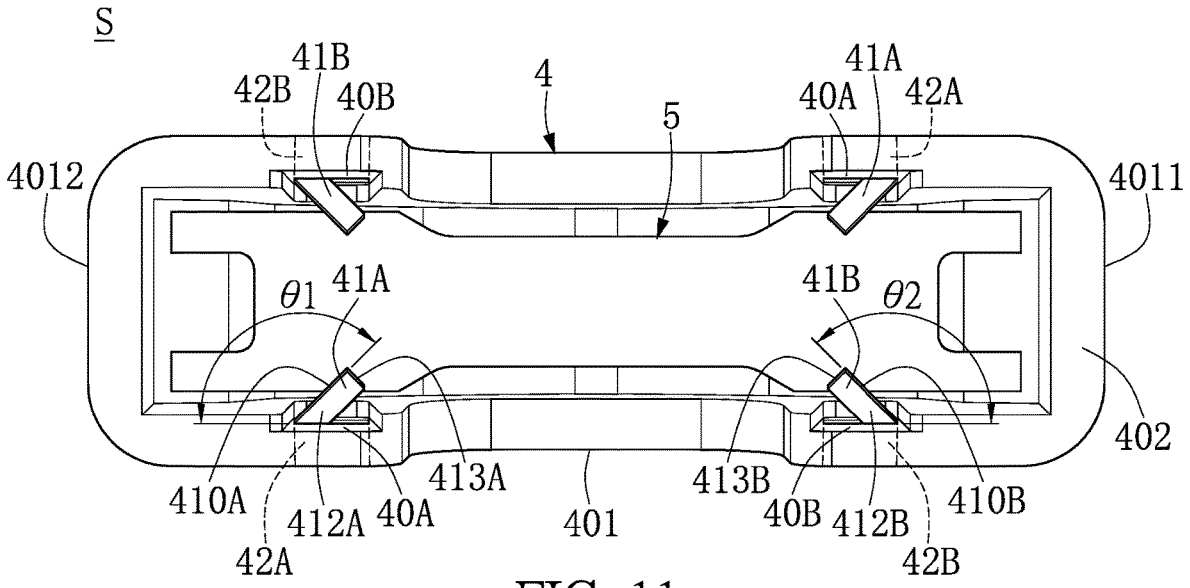
FIG. 11 shows a bottom, schematic view of the cap structure according to the second embodiment of the present disclosure.
Figure 12:
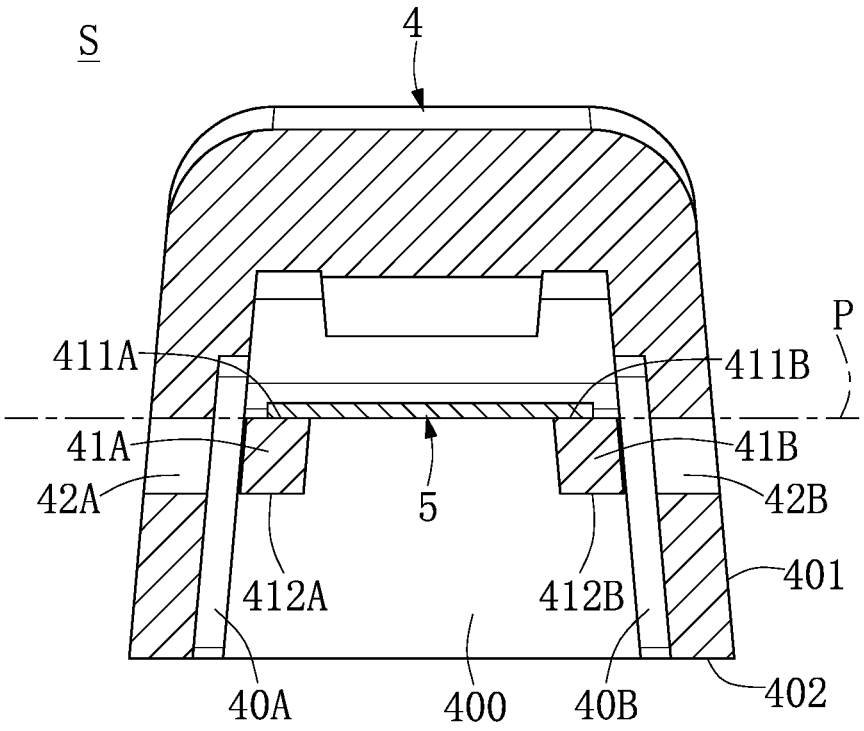
FIG. 12 shows a cross-sectional view taken along the section line XII-XII of FIG. 10.

Referring to FIG. 10 to FIG. 12, the second embodiment of the present disclosure provides a zipper head assembly structure Z, and the cap body 4 and the elastic piece 5 can be combined with each other to form a cap structure S. Comparing FIGS. 4~6 with FIGS. 10~12, the difference between the second embodiment and the first embodiment is as follows: in the second embodiment, referring to FIG. 10 to FIG. 12, the cap body 4 has at least two second inner concave grooves 40B corresponding to each other, at least two second retaining blocks 41B corresponding to each other and respectively extending outwardly from the two second inner concave grooves 40B, and at least two second through holes 42B corresponding to each other and respectively adjacent to the two second retaining blocks 41B. In addition, the two second inner concave grooves 40B are disposed on the inner surface 400 of the cap body 4, the two second through holes 42B pass through the cap body 4 to form another two breach holes between the inner surface 400 and the outer surface 401 of the cap body 4 (for example, another two breach holes 42A are formed by dotting or punching the cap body 4 from the outer surface 401 to the inner surface 400), and the two second retaining blocks 41B contact the elastic piece 5 for retaining or abutting the elastic piece 5. Therefore, the two second inner concave grooves 40B can be formed on the inner surface 400 of the cap body 4 in advance, so that the thickness between the inner surface 400 and the outer surface 401 of the cap body 4 can be decreased or thinned, and thus it is easy to concurrently form the second through hole 42B and the second retaining block 41B by a dotting or punching machine.

More particularly, referring to FIG. 11, the two second inner concave grooves 40B can be diagonally disposed on the inner surface 400 of the cap body 4, and the two second inner concave grooves 40B are respectively adjacent to two opposite end sides (4011, 4012) of the cap body 4. The two second retaining blocks 41B can be respectively and diagonally disposed on the two second inner concave grooves 40B, and the two second retaining blocks 41B are respectively adjacent to the two opposite end sides (4011, 4012) of the cap body 4. The two second through holes 42B can be diagonally disposed on the outer surface 401 of the cap body 4, and the two second through holes 42B are respectively adjacent to the two opposite end sides (4011, 4012) of the cap body 4. In other words, the two second inner concave grooves 40B and the two second retaining blocks 41B are disposed on the long lateral side of the inner surface 400 of the cap body 4, and the two second through holes 42B are disposed on the long lateral side of the outer surface 401 of the cap body 4. Therefore, the position of the second inner concave groove 40B, the second retaining block 41B, or the second through hole 42B is rotated relative to the end side (4011 or 4012) of the cap body 4 by 90 degrees.

For example, referring to FIG. 4 and FIG. 10, each second inner concave groove 40B has a second end 401B connected to the bottom surface 40B of the cap body 4 and a second end 402B opposite to the second end 401B and far away from the bottom surface 402 of the cap body 4, and the width (no label) of the second inner concave groove 40B is narrowed gradually from the second end 401B to the second end 402B of the second inner concave groove 40B. However, the above-mentioned design for the second inner concave groove 40B of the second embodiment is merely an example and is not meant to limit the present disclosure.

More particularly, referring to FIG. 5, FIG. 6, FIG. 11 and FIG. 12, each second retaining block 41B is adjacent to the second end 402B of the corresponding second inner concave groove 40B, and each second through hole 42B is adjacent to the second end 402B of the corresponding second inner concave groove 40B.

Referring to FIG. 10 to FIG. 12, it should be noted that each of the second retaining blocks 41B (i.e., the retaining block) has an inner surface 410B extending inwardly from the inner surface 400 of the cap body 4 (that is to say, the inner surface 410B extends along a long axle of the cap body 4, not along a short axle of the cap body 4), and the inner surface 410B of the second retaining block 41B is inclined at a second adjustable angle θ2 (i.e., an adjustable angle) relative to the inner surface 400 of the cap body 4. In addition, each of the second retaining blocks 41B has a second top side surface 411B, a second bottom side surface 412B opposite to the second top side surface 411B, and a second front surface 413B connected between the second top side surface 411B and the second bottom side surface 412B. Moreover, the elastic piece 5 is supported by the two second top side surfaces 411B of the at least two second retaining blocks 41B so as to hold the elastic piece 5 on a predetermined plane P without being changed by a change of the second adjustable angle θ2. That is to say, no matter how the second adjustable angle θ2 is adjusted or changed, the elastic piece 5 can be supported by the two second top side surfaces 411B so as to keep the elastic piece 5 on the predetermined plane P, so that the elastic piece 5 cannot be inclined when the second adjustable angle θ2 is adjusted or changed.

Figure 13:
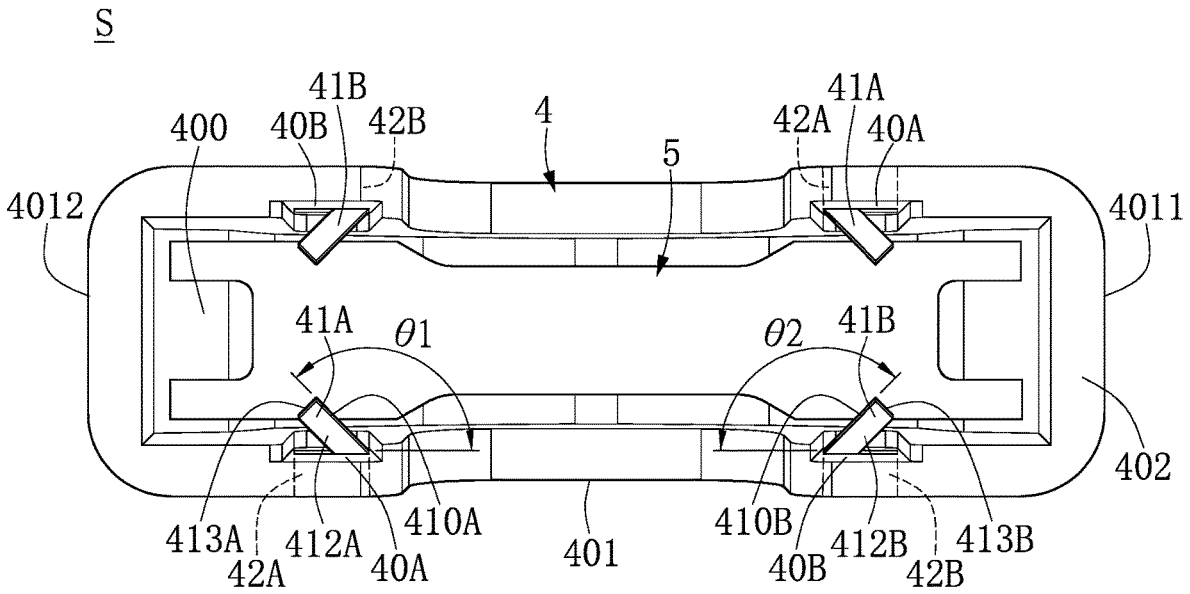
FIG. 13 shows a bottom, schematic view of another cap structure according to the second embodiment of the present disclosure.
Figure 14:
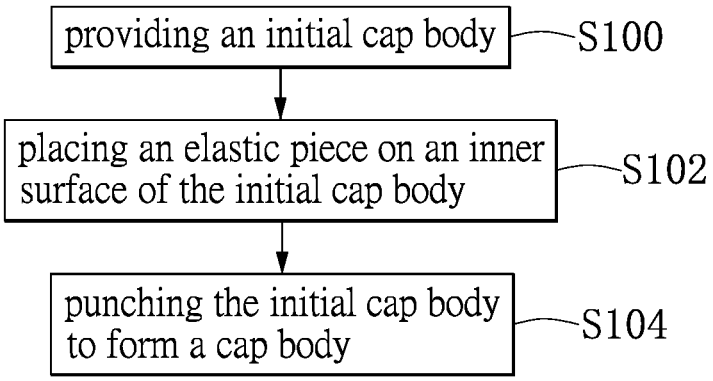
FIG. 14 shows a flowchart of a method of manufacturing a cap structure according to the present disclosure.

Referring to FIG. 11 and FIG. 13, it should be noted that the extending direction of each of the at least two second retaining blocks 41B can be changed according to different requirements, but no matter how the extending direction of each of the at least two second retaining blocks 41B is changed, the elastic piece 5 can be supported by the two second top side surfaces 411B so as to keep the elastic piece 5 on the predetermined plane P, so that the elastic piece 5 cannot be inclined when the extending direction of each of the at least two second retaining blocks 41B is changed.

More particularly, referring to FIG. 4 to FIG. 8 and FIG. 14, the present disclosure further provides a method of manufacturing a cap structure S, including: firstly, referring to FIG. 7, providing an initial cap body 4' (S100); next, referring to FIG. 7, placing an elastic piece 5 on an inner surface of the initial cap body 4' (S102); and then referring to FIG. 7 and FIG. 8, punching the initial cap body 4' to form a cap body 4 (S104). Therefore, the first adjustable angle θ1 of each first retaining blocks 41A relative to the inner surface 400 of the cap body 4 is changeable or adjustable according to a punching force generated by punching the initial cap body 4' as shown in FIG. 5, FIG. 7 and FIG. 8, and the second adjustable angle θ2 of each second retaining blocks 41B relative to the inner surface 400 of the cap body 4 is changeable or adjustable according to a punching force generated by punching the initial cap body 4' as shown in FIG. 13.

More particularly, the cap body 4 includes at least two first inner concave grooves 40A corresponding to each other, at least two first retaining blocks 41A corresponding to each other and respectively extending outwardly from the two first inner concave grooves 40A, and at least two first through holes 42A corresponding to each other and respectively adjacent to the two first retaining blocks 41A. The two first retaining blocks 41A can contact the elastic piece 5 for retaining or abutting the elastic piece 5 (i.e., the elastic piece 5 can be retained inside the cap body 4 through the two first retaining blocks 41A). In addition, the cap body 4 has an inner surface 400, an outer surface 401 and a bottom surface 402 connected between the inner surface 400 and the outer surface 401, the two first inner concave grooves 40A are disposed on the inner surface 400 of the cap body 4, and the two first through holes 42A pass through the cap body 4 to form two breach holes between the inner surface 400 and the outer surface 401 of the cap body 4. Therefore, the two first inner concave grooves 40A can be formed on the inner surface 400 of the cap body 4 in advance, so that the thickness between the inner surface 400 and the outer surface 401 of the cap body 4 can be decreased or thinned, and thus it is easy to concurrently form the first through hole 42A and the first retaining block 41A by a dotting or punching machine.

In conclusion, by virtue of "the inner surface (410A or 410B) of the retaining block (41A or 41B) being inclined at an adjustable angle (θ1 or θ2) relative to the inner surface 400 of the cap body 4" and "the elastic piece 5 being supported by the at least two retaining blocks (41A or 41B) so as to hold the elastic piece 5 on a predetermined plane P", the elastic piece 5 can be held on the predetermined plane P without being changed by a change of the adjustable angle (θ1 or θ2).

More particularly, the two second inner concave grooves 40A can be formed on the inner surface 400 of the cap body 4 by a die casting process and the two first retaining blocks 41A and the two first through holes 42A can be concurrently formed by a dotting or punching machine, so that when the elastic piece 5 is disposed on the inner surface 100 of the cap body 4, the two first retaining blocks 41A can contact the elastic piece 5 for retaining or abutting the elastic piece 5, so that the production efficiency of manufacturing the cap structure S and the robustness of retaining the elastic piece 5 by the two first retaining blocks 41A can be increased.

The aforementioned descriptions merely represent the preferred embodiments of the present disclosure, without any intention to limit the scope of the present disclosure which is fully described only within the following claims. Various equivalent changes, alterations or modifications based on the claims of the present disclosure are all, consequently, viewed as being embraced by the scope of the present disclosure.

What is claimed is:

1. A method of manufacturing a cap structure, comprising:

providing an initial cap body;

placing an elastic piece on an inner surface of the initial cap body; and punching the initial cap body to form a cap body, wherein the cap body includes at least two first retaining blocks for retaining the elastic piece and at least two first through holes respectively adjacent to the at least two first retaining blocks, wherein the cap body has an inner surface, an outer surface, and a bottom surface connected between the inner surface and the outer surface, and the at least two first through holes pass through the cap body to form two breach holes between the inner surface and the outer surface of the cap body;

wherein each of the first retaining blocks has an inner surface extending inwardly from the inner surface of the cap body, and the inner surface of the first retaining block is inclined at a first adjustable angle relative to the inner surface of the cap body;

wherein the first adjustable angle of one of the at least two first retaining blocks relative to the inner surface of the cap body is larger than, equal to or smaller than the first adjustable angle of another one of the at least two first retaining blocks relative to the inner surface of the cap body;

wherein each of the first retaining blocks has a first top side surface connected to the inner surface of the cap body, a first bottom side surface opposite to the first top side surface and connected to the inner surface of the cap body, and a first front surface connected between the first top side surface and the first bottom side surface and separated from the inner surface of the cap body, and the elastic piece is supported by the two first top side surfaces of the at least two first retaining blocks so as to hold the elastic piece on a predetermined plane without being changed by a change of the first adjustable angle;

wherein, in the step of punching the initial cap body to form the cap body, when a first mold and a second mold respectively and concurrently contact two lateral sides of the initial cap body, a first processing tool of the first mold and a second processing tool of the second mold are respectively and concurrently inserted into the two lateral sides of the initial cap body so as to respectively form the at least two first retaining blocks of the cap body.

2. The method of claim 1, wherein the cap body has at least two first inner concave grooves corresponding to each other, the at least two first retaining blocks are respectively extending outwardly from the at least two first inner concave grooves, and the at least two first inner concave grooves are disposed on the inner surface of the cap body.

3. The method of claim 2, wherein the at least two first inner concave grooves are diagonally disposed on the inner surface of the cap body, and the at least two first inner concave grooves are respectively adjacent to two opposite end sides of the cap body, wherein the at least two first retaining blocks are respectively and diagonally disposed on the at least two first inner concave grooves, and the at least two first retaining blocks are respectively adjacent to the two opposite end sides of the cap body, wherein the at least two first through holes are diagonally disposed on the outer surface of the cap body, and the at least two first through holes are respectively adjacent to the two opposite end sides of the cap body.

4. The method of claim 2, wherein each first inner concave groove has a first end connected to the bottom surface of the cap body and a second end opposite to the first end, and the width of the first inner concave groove is narrowed gradually from the first end to the second end of the first inner concave groove.

5. The method of claim 1, wherein the cap body has at least two second inner concave grooves corresponding to each other, at least two second retaining blocks corresponding to each other and respectively extending outwardly from the at least two second inner concave grooves, and at least two second through holes corresponding to each other and respectively adjacent to the at least two second retaining blocks, the at least two second inner concave grooves are disposed on the inner surface of the cap body, the at least two second through holes pass through the cap body to form another two breach holes between the inner surface and the outer surface of the cap body, and the at least two second retaining blocks contact the elastic piece for retaining the elastic piece, wherein each of the second retaining blocks has an inner surface extending inwardly from the inner surface of the cap body, and the inner surface of the second retaining block is inclined at a second adjustable angle relative to the inner surface of the cap body, and wherein each of the second retaining blocks has a second top side surface, a second bottom side surface opposite to the second top side surface, and a second front surface connected between the second top side surface and the second bottom side surface, and the elastic piece is supported by the two second top side surfaces of the at least two second retaining blocks so as to hold the elastic piece on a predetermined plane without being changed by a change of the second adjustable angle.

6. The method of claim 5, wherein the at least two second inner concave grooves are diagonally disposed on the inner surface of the cap body, and the at least two second inner concave grooves are respectively adjacent to two opposite end sides of the cap body, wherein the at least two second retaining blocks are respectively and diagonally disposed on the at least two second inner concave grooves, and the at least two second retaining blocks are respectively adjacent to the two opposite end sides of the cap body, wherein the at least two second through holes are diagonally disposed on the outer surface of the cap body, and the at least two second through holes are respectively adjacent to the two opposite end sides of the cap body.

7. A method of manufacturing a cap structure, comprising:

providing an initial cap body;

placing an elastic piece on an inner surface of the initial cap body; and punching the initial cap body to form a cap body, wherein the cap body includes at least two first retaining blocks for retaining the elastic piece;

wherein each of the first retaining blocks has an inner surface extending inwardly from an inner surface of the cap body, and the inner surface of the first retaining block is inclined at a first adjustable angle relative to the inner surface of the cap body;

wherein the first adjustable angle of the first retaining block relative to the inner surface of the cap body is changeable according to a punching force generated by punching the initial cap body;

wherein the first adjustable angle of one of the at least two first retaining blocks relative to the inner surface of the cap body is larger than or smaller than the first adjustable angle of another one of the at least two first retaining blocks relative to the inner surface of the cap body;

wherein, in the step of punching the initial cap body to form the cap body, when a first mold and a second mold respectively and concurrently contact two lateral sides of the initial cap body, a first processing tool of the first mold and a second processing tool of the second mold are respectively and concurrently inserted into the two lateral sides of the initial cap body so as to respectively form the at least two first retaining blocks of the cap body.

8. A method of manufacturing a cap structure, comprising:

providing an initial cap body;

placing an elastic piece on an inner surface of the initial cap body; and punching the initial cap body to form a cap body, wherein the cap body includes at least two first retaining blocks for retaining the elastic piece;

wherein each of the first retaining blocks has a first top side surface connected to an inner surface of the cap body, a first bottom side surface opposite to the first top side surface and connected to the inner surface of the cap body, and a first front surface connected between the first top side surface and the first bottom side surface and separated from the inner surface of the cap body, and the elastic piece contacts the two first top side surfaces of the at least two first retaining blocks and is separated from the two first front surfaces of the at least two first retaining blocks;

wherein, in the step of punching the initial cap body to form the cap body, when a first mold and a second mold respectively and concurrently contact two lateral sides of the initial cap body, a first processing tool of the first mold and a second processing tool of the second mold are respectively and concurrently inserted into the two lateral sides of the initial cap body so as to respectively form the at least two first retaining blocks of the cap body.

* * * * *